United States Patent [19]

Katchka

[11] Patent Number: 5,067,178

[45] Date of Patent: Nov. 26, 1991

[54] UNDERGARMENT

[76] Inventor: Michael P. Katchka, 180 Mohawk, Pontiac, Mich. 48053

[21] Appl. No.: 408,844

[22] Filed: Sep. 18, 1989

Related U.S. Application Data

[63] Continuation-in-part of Ser. No. 210,495, Jun. 23, 1988.

[51] Int. Cl.[5] ..... A41B 9/00; A41C 3/00

[52] U.S. Cl. ..... 2/250; 2/67; 2/243 A; 2/247; 2/402; 2/403; 2/406; 450/89

[58] Field of Search ..... 2/23, 24, 67, 75, 80, 2/90, 115, 211, 243 A, 227, 247, 248, 249, 250, 251, 252, 409, 402, 403, 406; 450/89

[56] References Cited

U.S. PATENT DOCUMENTS

| | | | |
|---|---|---|---|
| 1,107,219 | 8/1914 | Kops | 2/243 A |
| 1,473,427 | 11/1923 | Handley | 2/243 A |
| 1,733,160 | 10/1929 | Levinson | 2/24 |
| 1,797,208 | 3/1931 | Weisz | 2/67 X |
| 2,333,428 | 11/1943 | Kinsey | 2/160 |
| 2,341,798 | 2/1944 | Lesser | 2/115 |
| 2,389,721 | 11/1945 | Durso | 2/247 |
| 2,432,325 | 12/1947 | McDougall | 2/160 |
| 2,537,701 | 1/1951 | Previdi | 2/250 |
| 2,558,382 | 6/1951 | Previdi | 2/250 |
| 3,438,062 | 4/1967 | Dobell | 2/247 |
| 3,453,662 | 7/1969 | Weiss | 2/115 X |
| 3,484,974 | 12/1969 | Culmone | 2/DIG. 6 |
| 3,611,444 | 12/1969 | Rector | 2/247 |
| 3,871,030 | 3/1975 | Green | 2/250 |
| 4,145,762 | 3/1979 | Wallach | 2/67 |
| 4,173,976 | 11/1979 | Bloomquist et al. | 2/403 X |
| 4,213,312 | 7/1980 | Safrit et al. | 2/409 X |
| 4,247,097 | 1/1981 | Schwartz | 2/160 |
| 4,330,120 | 5/1982 | Netti | 2/160 |
| 4,370,696 | 1/1983 | Darrell | 2/160 |
| 4,387,838 | 6/1983 | Jackson | 2/160 |
| 4,637,075 | 1/1987 | Ingrisano et al. | 2/247 X |
| 4,651,355 | 3/1987 | White | 2/247 |
| 4,875,241 | 10/1989 | Browder, Jr. et al. | 2/243 A X |
| 4,899,395 | 2/1990 | Spector | 2/247 X |

FOREIGN PATENT DOCUMENTS

| | | | |
|---|---|---|---|
| 310486 | 10/1955 | Switzerland | 2/67 |
| 2143422 | 2/1985 | United Kingdom | 2/400 |

OTHER PUBLICATIONS

Maurice Gershman, "Self Adhering Nylon Tapes", The Journal of the American Medical Association, vol. 168, No. 7, p. 930, dated Oct. 19, 1958.

*Primary Examiner*—Werner H. Schroeder
*Assistant Examiner*—Jeanette E. Chapman
*Attorney, Agent, or Firm*—Weintraub, DuRoss & Brady

[57] ABSTRACT

The present invention involves an undergarment and an integral pocket secured thereto. The invention is applicable to men's brief, men's boxer shorts, women's panties, women's brassieres, and to pockets which may be secured thereto. The undergarment is generally made of a first material, and the pocket is made of second material being stretched taut across the body portion. The pocket has an elasticized band of material disposed across the opening thereof, the elasticized band of material b eing stretched taut across the body portion. The pocket opening includes a double density of material. Preferably, the pocket material is made of a plurality of stretch fibers which are oriented transversely from a plurality of nonstretch fibers.

17 Claims, 1 Drawing Sheet

UNDERGARMENT

CROSS-REFERENCE TO RELATED APPLICATIONS

This is a continuation-in-part application of co-pending U.S. application Ser. No. 07/210,495 entitled "Undergarment" by Michael P. Katchka, the application being filed on June 23rd, 1988, the disclosure of which is incorporated by reference.

BACKGROUND OF THE INVENTION

1. Field of the Invention

The present invention relates to an undergarment and a pocket, and more particularly, to an undergarment having a pocket made of a highly elastic material.

2. Background Art

As people are becoming increasingly concerned about the spread of AIDS and other sexually communicable diseases, the use of condoms is increasing both as a means of preventing the spread of such diseases, and as an acceptable form of birth control. However, there is currently no convenient way for a person to carry a condom.

During World War II when rubber was becoming increasingly scarce due to military applications, the chemical and the fiber industries sought to develop a synthetic fiber to replace rubber. Spandex was developed and is a generic term for a synthetic material where the fiber-forming substance is a long chain synthetic polymer composed of at least 85% of a segmented polyurethane. A long-chain polyester is combined with a short diisocyanate to produce a polymer containing long lengths of a relatively hard material to form the segmented polyurethane. In the relaxed state, the fibers are rather weak and may be easily stretched. However, as the fiber is elongated, the long segments align and form strong, stiff crystals which prevent further extension. By combining the hard segments with the soft segments, these fibers can be engineered to provide almost any required degree of stretch and strength. Other synthetic fibers providing a high degree of elasticity include Lastex, and Amin/8.

The tensile strength of spandex is substantially higher than that of rubber, and is superior to rubber in its high resistance to chafing under stress and strain. By spinning as little as 5% to 10% of spandex into a yarn, a yarn of high stretch and excellent recovery can be produced. The degree of recovery can be controlled from a very low percentage to one as high as 200%, depending on the yarn construction.

What is needed is a new structure enabling a person to carry and storing personal effects, such as a condom, in a discreet manner within the normal wearing apparel of the person.

SUMMARY OF THE INVENTION

The principle advantage of the present invention is to provide a pocket with a high degree of elasticity, preferentially in only one direction, the pocket being discreetly located relatively close to the person's body, thereby providing a secure and convenient place for keeping personal effects, so that the personal effects are available as needed. The pocket is discreetly concealed within the undergarment of the wearer and is not visible through the clothing of the wearer.

The preferred embodiment of the present invention is an undergarment and an integral pocket secured thereto. If the undergarment is to be worn around the trunk of an adult person, the pocket is preferably secured to the undergarment below the waistband and above the crotch area. The pocket has an opening across an edge thereof, and includes an elasticized band of material across the open edge thereof.

The pocket is preferably made of a highly elastic material, such as spandex, while the undergarment is made of pure cotton, or a fiber blend of essentially all cotton for the comfort of the wearer. The fiber material for the pocket is preferably highly elastic in only one direction, the transverse fiber material being essentially nonelastic.

For a more complete understanding of the undergarment of the present invention, reference is made to the following detailed description and accompanying drawings in which the presently preferred embodiments of the invention are illustrated by way of example. It is expressly understood, however, that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 1:
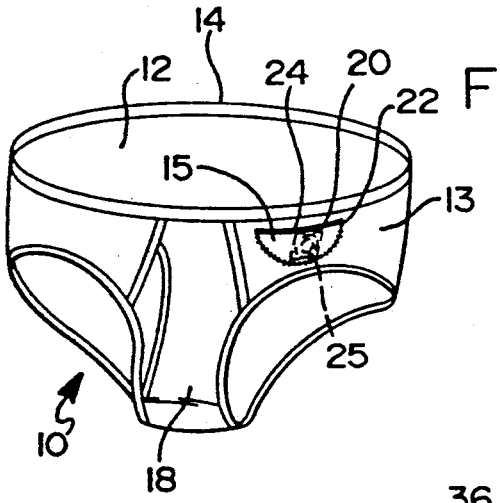
FIG. 1 is a preferred embodiment of the present invention; depicting the front view of a pair of men's briefs.

Referring now to the drawings, FIG. 1, the undergarment 10 is depicted therein with a pair of men's briefs 12 having a a body portion 13 and an integral pocket 15 secured to the body portion 13. The body portion 13 is made of a first material. The pocket is secured to the briefs 12 between the waistband 14 and the crotch area 18. The pocket 15 has an opening 20 across the top edge 22 for access to the personal effects 25 carried therein. The opening 20 across the top edge 22 is generally parallel to the waistband 14.

The pocket 15 is made of a material that is different than the body-portion material. The pocket material is stretchable preferably in only one direction, which is preferably essentially parallel to the opening 20 across the top edge 22. The pocket material has a higher degree of elasticity than the body-portion material. The recovery of the pocket material after being stretched is essentially complete. The pocket material is preferably a blend containing a segmented polyurethane, such as spandex. The segmented polyurethane has a tensile strength substantially higher than rubber.

Preferably, the pocket material has a higher degree of elasticity than the body-portion material. The pocket material is made from a first plurality of fibers 46 and a second plurality of fibers 48, the first plurality of fibers 46 being oriented essentially transversely to the second plurality of fibers 48 (see FIG. 6). The first plurality of fibers 46 are elastic, and the second plurality of fibers 48 are essentially nonelastic.

The pocket 15 includes an elasticized band of material 24 disposed across the open edge thereof. The elasticized band of material 24 prevents the personal effects 25 from being dislodged from the pocket 15 during the normal activity of the wearer. The pocket 15 is preferably made of a stretchable knitted fabric, with the elasticized band of material 24 disposed along the top edge thereof. The elasticized band of material 24 and the double density of the first material disposed along the top edge of the pocket 15 enable retention of the personal effects 25 securely within the pocket 15. The elasticized band of material 24 is stretched so as to be substantially taut when the pocket 15 is empty, to ensure a secure retention within the pocket 15 of the personal effects 25.

Figure 2:
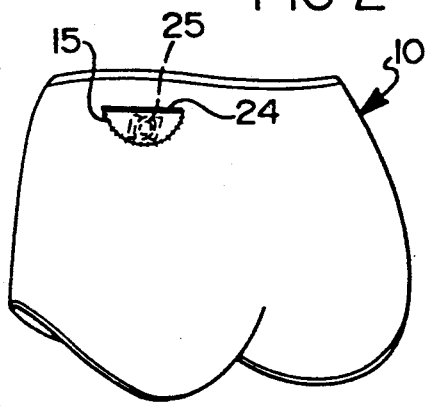
FIG. 2 is another preferred embodiment of the present invention with the pocket in the rear on the inside surface depicting the rear view of a pair of women's panties.

The pocket 15 has a unique size, shape, location, and position relative to the undergarment 10. The size of the pocket 15 is slightly larger than the personal effects 25, and is designed to receive a single condom. The shape of the pocket 15 is an elongated rectangle having rounded corners. The pocket 15 is located on the outside of the undergarment 10, although on loose-fitting boxer shorts or the like the pocket 15 may be located on the inside of the undergarment 10. The pocket 15 is preferably located along the front of the undergarment 10, but if it is located on the back of the undergarment 10 (see FIG. 2) it must be located high enough so that the personal effects 25 will not be damaged when the wearer is seated, or cause discomfort to the wearer. The position of the pocket 15 is about two inches below the waistband 14, so that the pocket 15 and the contents thereof do not interfere with the free movement of the wearer.

The pocket material is preferably a spandex blend, although other synthetic fibers providing a high degree of elasticity include Lastex, and Amin/8 may also be used. Spandex is a chain synthetic polymer comprised of at least 85% of a segmented urethane, which is the same substance widely used as a foam in bonded and laminated fabrics and furniture.

Spandex is composed of at least 85% of a segmented polyurethane. A long-chain polyester is combined with a short diisocynate to produce a polymer containing long lengths of a relatively soft material joined by short lengths of a relatively hard material to form the segmented polyurethane. In the relaxed state, the fibers are rather weak and may be easily stretched. However, as the fiber is elongated, the long segments align and form strong, stiff crystals which prevent further extension. By combining the hard segments with the soft segments, these fibers can be engineered to provide any required degree of stretch and strength.

Spandex is extruded as a monofilament, or in a multiplicity of fine filaments which immediately form a monofilament. Spandex has a high degree of stretch; over 500% without breaking. Spandex has a low set, in that it has remarkable ability to spring back to its original shape, with only a marginal amount of change in length. The tensile strength of spandex is substantially higher than that of rubber. Spandex is superior to rubber in its high resistance to chafing under stress and strain.

By spinning as little as 5% to 10% of spandex into a yarn can produce a yarn of high stretch and excellent recovery. The degree of recovery can be controlled from a very low percentage to one as high as 200%, depending on the yarn construction. The corespun yarn takes on the aesthetic characteristics, in hand and in appearance, of whatever fibers are used in outer sheath. Since the elastic core is buried in the casing of the sheath fibers, the spandex does not appear on the surface of the fabric.

Figure 4:
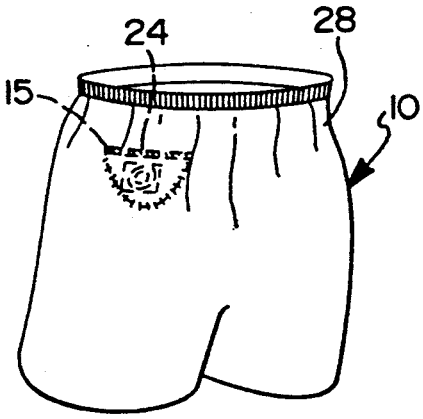
FIG. 4 is another preferred embodiment of the present invention depicting the front view of a pair of men's boxer shorts.

When the undergarment 10 is loose-fitting, such as boxer shorts 28 or pajama bottoms (not shown), the pocket 15 is preferably located on the inside of the undergarment 10 and thereby concealed (see FIG. 4). If the undergarment 10 is tight-fitting (such as a men's briefs, or a women's panties or brassiere), the pocket 15 is disposed on the outside to minimize rubbing of the pocket 15 and its contents against the skin of the wearer.

Figure 3:
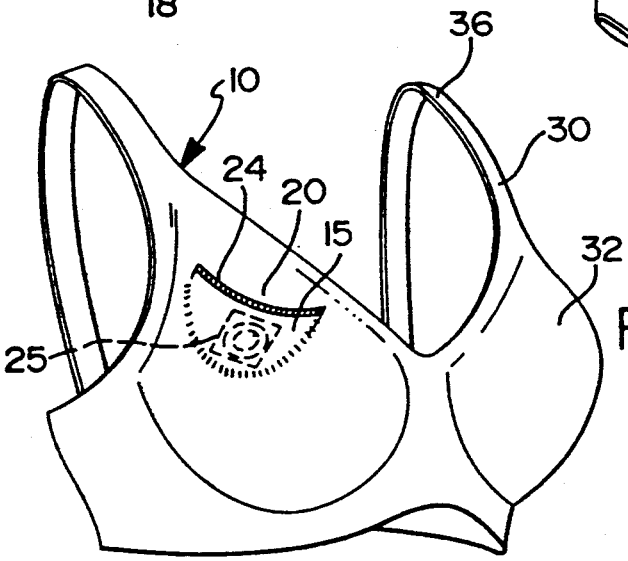
FIG. 3 is yet another preferred embodiment of the present invention depicting a brassiere.

The undergarment 10 may also be a brassiere 30 (see FIG. 3). The pocket 15 is preferably attached to the outside upper portion of one of the cups 32. The brassiere 30 comprises a body portion 31 to be worn about the torso of the woman, means 36 to secure the body portion 31 to the torso of the woman, a pocket 15 being secured to the body portion 31, and an elasticized band of material 24 disposed across the open edge of the pocket 15.

The body portion 31 is made of a first material, the pocket 15 is made of a second material, and the second material is different than the first material. The second material is stretchable preferably in only one direction, which is preferably essentially parallel to the opening 20 across the top edge 22. The second material has a higher degree of elasticity than the first material. The recovery of the second material after being stretched is essentially complete. The second material is preferably a blend containing a segmented polyurethane, such as spandex. The segmented polyurethane has a tensile strength substantially higher than rubber.

The elasticized band of material 24 disposed across the open edge of the pocket is stretched taut across the body portion, and the open edge of the pocket has a double density of the second material.

Figure 5:
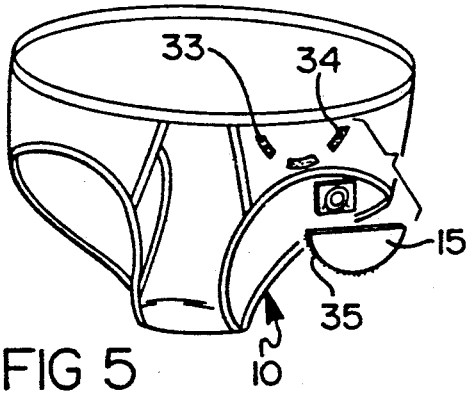
FIG. 5 is a front assembly view of another embodiment of the present invention depicting a pair of men's briefs.

In another embodiment as shown in FIG. 5, the pocket 15 is attachable to and detachable from the undergarment 10 by the use of tape, VELCRO, or the like. The pocket 15 is surrounded on essentially three sides of the perimeter thereof by closure means 34 which secure the pocket 15 to the undergarment 10. In this embodiment the pocket 15 is not an integral part of the undergarment 10, but rather is attachable thereto by the closure means 34.

The closure means 34 may be velcro® interlocking strips, which consist of two parts 33 and 35, one being a nonwoven material such as felt and the other part being a flexible material provided with a plurality of hook-like loops of stiff resilient plastic material, such as nylon, projecting from the face of the material. When the two connecting strips 33 and 35 are pressed together the hooks lock with the fibers of the felt holding the two materials together. The connection and the separation may be repeated innumuerable times. One connecting strip 33 is secured to the pocket 15 and the other connecting strip 35 is secured to the undergarment 1.

The closure means 34 may be functional equivalent of velcro ®-type fasteners, such as snaps, or buttons may also be used. Also, the perimeter of the pocket 15 may be coated with an adhesive to secure it to a fabric, and subsequently removed therefrom. The closure means 34 are preferably relatively inexpensive and can take numerous washings without damage.

Figure 6:
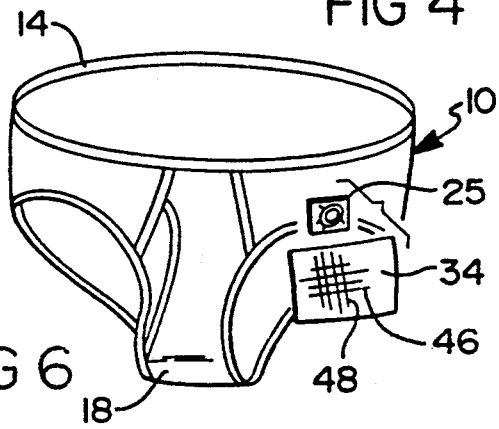
FIG. 6 is a front assembly view of yet another embodiment of the present invention depicting a pair of men's briefs.

In yet another embodiment as shown in FIG. 6, the means 38 for attaching the personal effects 25 to the undergarment 10 may be accomplished by velcro ® tape or a wide tape containing an adhesive which does not damage the fabric of the undergarment 10 upon removal therefrom. The attaching means 38 simply covers the personal effects 25, securing the personal effects 25 to the undergarment 10. If velcro ® is used, one connecting strip is secured to the pocket 15 to mate with the other connecting strip.

While the undergarment and securing means have been described in conjunction with several specific embodiments, it is evident that many alternatives, modifications, and variations will be apparent to those skilled in the art in light of the disclosure herein. It is intended that all such alternatives, modifications and variations are included herein that fall within the spirit and scope of the appended claims.

I claim:

1. An undergarment for retaining personal effects in a secure manner during the normal course of activities of a wearer of the undergarment, the undergarment comprising:

(a) a body portion to be worn about the trunk below the waist of the wearer, the body portion being made of a body-portion material;

(b) a waistband that is affixed to the body portion, the waistband being wearable about the waist of the wearer; and (c) a pocket being secured to the body portion, the pocket being made of a pocket material which is different from the body-portion material, the pocket material being elastic in one direction only, the pocket having an opening disposed across a portion thereof, an elasticized band of material being disposed across the pocket adjacent the opening, the elasticized band of material being stretched taut across the pocket opening, the top portion of the pocket having a double density of the pocket material.

2. The undergarment of claim 1, wherein the pocket material has a higher degree of elasticity than the body-portion material.

3. The undergarment of claim 1, wherein the pocket material is made from a first plurality of fibers and a second plurality of fibers, the first plurality of fibers being oriented essentially transversely to the second plurality of fibers, the first plurality of fibers being elastic, the second plurality of fibers being essentially nonelastic.

4. The undergarment of claim 1, wherein the body-portion material is essentially nonelastic.

5. The undergarment of claim 1, wherein the pocket material includes segmented polyurethane, the segmented polyurethane having a tensile strength substantially higher than rubber.

6. The undergarment of claim 1, wherein the recovery of the pocket material after being stretched is essentially complete.

7. A brassiere for retaining personal effects of a woman in a secure manner during the normal course of activities of the woman, the brassiere comprising:

(a) a body portion to be worn, about the torso of the woman, the body portion including two cups, the body portion supporting the breasts of the woman, each cup having a top section and a bottom section, the body portion being made of a body-portion material;

(b) means to secure the body portion to the torso of the woman; and (c) a pocket being secured to the body portion, the pocket being made of a pocket material which is different from the body-portion material, the pocket material being stretchable in one direction only, the pocket material being different from the body-portion material, the pocket having an opening disposed across a portion thereof, an elasticized band of material being stretched taut across the body portion, the open edge having a double density of the pocket material.

8. The brassiere of claim 7, wherein the pocket material has higher degree of elasticity than the body-portion material.

9. The brassiere of claim 7, wherein the pocket material is made from a first plurality of fibers and a second plurality of fibers, the first plurality of fibers being oriented essentially transversely to the second plurality of fibers, the first plurality of fibers being elastic, the second plurality of fibers being essentially nonelastic.

10. The brassiere of claim 7, wherein the pocket material includes segmented polyurethane, the segmented polyurethane having a tensile strength substantially higher than rubber.

11. The brassiere of claim 7, wherein the recovery of the pocket material after being stretched is essentially complete.

12. A system for carrying and concealing personal effects within the clothing of a person, the system comprising:

(a) an undergarment being made of an undergarment material;

(b) a pocket-sized panel being readily attachable to the undergarment and detachable from the undergarment along all but one open edge of the pocket-sized panel without damage thereto, the pocket-sized panel being made of a panel material which is different from the undergarment material, the panel material being stretchable in one direction only, an elasticized band of material being disposed across the panel adjacent the open edge thereof, the elasticized band of material being stretched taut across the undergarment, the portion of the panel adjacent the open edge being of double density.

13. The system of claim 12, wherein the panel material is different from the undergarment material, the panel material having a higher degree of elasticity than the first material.

14. The system of claim 12, wherein the panel material is made from a first plurality of fibers and a second plurality of fibers, the first plurality of fibers being essentially transverse to the second plurality of fibers, the first plurality of fibers being elastic, the second plurality of fibers being essentially nonelastic.

15. The system of claim 12, wherein the panel material includes segmented polyurethane, the segmented polyurethane having a tensile strength substantially higher than rubber.

16. The system of claim 12, wherein the recovery of the panel material after being stretched is essentially complete.

17. An undergarment for retaining personal effects in a secure manner during a normal course of activities of a wearer thereof, the undergarment comprising:

(a) a body portion to be worn about the torso of a wearer, the body portion being made of a body-portion material;

(b) a pocket which is secured to the body portion, the pocket being formed of a pocket material which is different from the body-portion material, and which is stretchable in one direction only.

* * * * *